United States Patent [19]

Netter

[11] Patent Number: 4,635,668

[45] Date of Patent: Jan. 13, 1987

[54] AUTOMATIC WATER LINE FREEZE CONTROL

[76] Inventor: Aaron J. Netter, Box 400, Waite Park, Minn. 56387

[21] Appl. No.: 775,777

[22] Filed: Sep. 13, 1985

[51] Int. Cl.[4] ..... E03B 7/10; F16L 55/00

[52] U.S. Cl. ..... 137/62; 137/392; 137/551; 137/554; 137/624.15; 137/624.18; 340/593; 340/595; 374/148; 374/170; 374/183

[58] Field of Search ..... 137/59, 62, 392, 624.13, 137/624.15, 624.18, 624.19, 554; 340/584, 593, 594, 595, 596, 597, 598, 599; 374/147, 148, 170, 183

[56] References Cited

U.S. PATENT DOCUMENTS

| | | | |
|---|---|---|---|
| 1,028,808 | 6/1912 | Campbell | 137/62 |
| 1,226,696 | 5/1917 | Ramseur | 137/59 |
| 1,786,878 | 12/1930 | Van Keuren | 137/62 |
| 2,565,323 | 8/1951 | Quinn | 340/595 |
| 3,817,105 | 6/1974 | Luhowy | 374/170 |
| 3,872,726 | 3/1975 | Kauffeld et al. | 374/170 |
| 3,922,640 | 11/1975 | Ruof | 340/595 |
| 4,086,812 | 5/1978 | Luthe et al. | 374/170 |

FOREIGN PATENT DOCUMENTS

| | | | |
|---|---|---|---|
| 46777 | 8/1939 | Netherlands | 137/62 |
| 2074640 | 11/1981 | United Kingdom | 137/62 |

*Primary Examiner*—George L. Walton

*Attorney, Agent, or Firm*—Merchant, Gould, Smith, Edell, Welter & Schmidt

[57] ABSTRACT

An automatic freeze control (10) includes a temperature sensor (18) and a valve (20) connected to the water line (22). Control circuitry (36, 38, 40, 42, 44 and 46) is responsive to the line water temperature continuously monitored by the sensor (18) to selectively open the valve (20) for increased periodic flow with decreasing temperature.

10 Claims, 2 Drawing Figures

AUTOMATIC WATER LINE FREEZE CONTROL

TECHNICAL FIELD

The present invention relates generally to a temperature-responsive, electrical control device. More particularly to an automatic control for monitoring the temperature in a water line and selectively opening a solenoid valve to run the water for predetermined periods of time depending upon the temperature sensed, to help prevent freeze damage.

BACKGROUND ART

Frozen water lines are a common occurrence in the Northern states during winter, especially when there is an unusually long or unexpected cold snap. In addition to damage to the water line and fittings, such freeze damage usually results in a water leak that causes further damage to walls, ceilings and the like. Such leakage and damage may not be noticed immediately and can occur in an area of a building which is not readily accessible. A frozen water line can thus cause extensive damage which is difficult, time-consuming and expensive to repair.

In the past, the most common approaches to this problem have been to wrap the water line with electric heat tape and/or to open a water valve allowing enough flow to avoid a freeze up. There are, however, distinct limitations and disadvantages with these approaches. Both require at least some manual attention and are best suited for periodic, relatively short periods of usage. These approaches are not suitable for freeze line protection over extended periods, such as when the building is unoccupied, and both are relatively inefficient and often result in unnecessary waste of utilities. Also, there is the possibility of overheating and thus fire with electric heat tape.

In addition to the direct and indirect freeze damage, further damage can be done in thawing a frozen water line. Thawing is usually accomplished by directing electrical current through the line which in turn can promote galvanic corrosion in underground lines and fittings, and even cause damage to grounded appliances in the building from stray amperage.

A need has thus developed for an automatic water line freeze control which continuously monitors the temperature in a water line and opens a valve to control flow according to the temperature, without manual attention or undue waste of water.

SUMMARY OF INVENTION

The present invention comprises an automatic water line freeze control which overcomes the foregoing and other difficulties associated with the prior art. In accordance with the invention, there is provided an electrical control device which is particularly adapted to control periodic flow responsive to the temperature in the water line. The device comprises a temperature sensor and solenoid valve connected to the water line, and a remote control circuit responsive to the temperature sensor for selectively opening the solenoid valve for predetermined time intervals responsive to the temperature in the water line. In accordance with the preferred embodiment, the control circuitry herein is adapted to open the valve periodically for water temperatures above a maximum threshold temperature, below which the valve is opened at periodically shorter intervals with decreasing temperature until reaching a minimum threshold temperature at which the valve is held open for a relatively long interval. The control circuit is enclosed in a housing, and indicator lights are preferably provided to provide a visual signal of whether the water line temperature is in safe, cautionary, or hazardous ranges.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
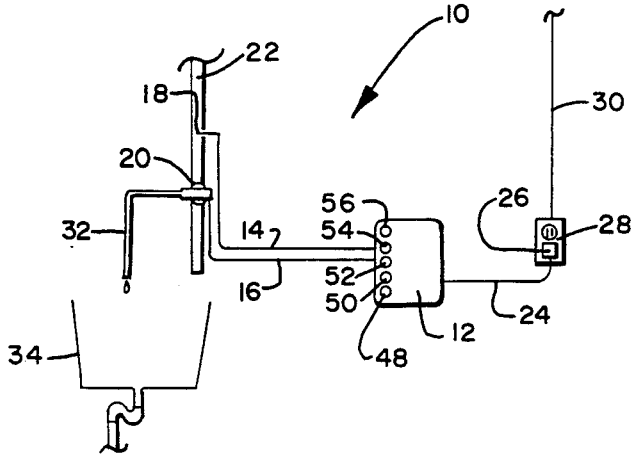
FIG. 1 is an illustration of the automatic water line freeze control of the invention, connected between a water line and an electrical power source.

Referring now to the Drawings, wherein like reference numerals designate like or corresponding elements between the views, and particularly referring to FIG. 1, there is shown the automatic water line freeze control 10 of the invention. The control 10 includes a housing 12 enclosing a control circuit which is coupled by lines 14 and 16 to a temperature sensor 18 and a normally-closed solenoid valve 20, respectively, connected to a water supply line 22. The sensor 18 preferably includes a thermistor connected in a conventional fashion to produce a varying voltage according to the temperature of the thermistor. However, other types of suitable temperature sensors can be used. The control circuit within housing 12 is also connected by line 24 to a plug 26 plugged into a receptacle 28 connected to a power supply line 30. As will be explained more fully hereinafter, the automatic water freeze line control 10 operates on a continuous basis without manual attention during cold weather to monitor the temperature in the water line 22 with sensor 18 and selectively open valve 20 allowing water to flow through a drain line 32 out into a sink 34 to help prevent freeze damage.

Figure 2:
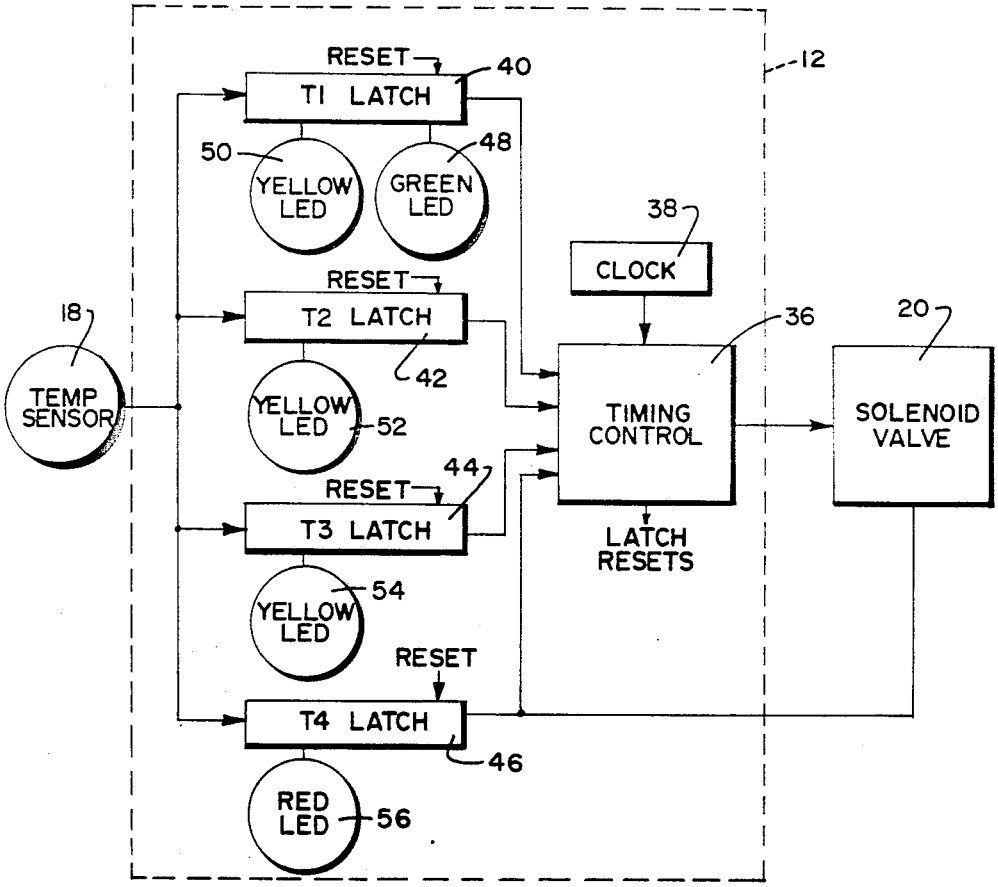
FIG. 2 is a schematic block diagram of the automatic water line freeze control herein.

Referring now to FIG. 2, there is shown a schematic block diagram of the control circuitry of the automatic water line freeze control 10. The control circuitry is located within housing 12, which can be formed of plastic or other suitable material, and mounted on any suitable surface, such as a basement wall. The control circuitry includes a plurality of latches coupled between the water line temperature sensor 18 and a timing control 36 which in turn is coupled to the valve 20. A clock 38 is also coupled to the timing control 236. As will be explained more fully hereinafter, the latches set when the water temperature reaches progressively lower predetermined setpoint temperatures to open and reclose valve 20 at periodically shorter time intervals, or increasing frequency, with decreasing temperature.

In the preferred embodiment, the control 10 incorporates four latches 40, 42, 44 and 46 having different setpoint temperatures. Each latch preferably includes a comparator set to trigger and set the latch when a selected voltage is produced by temperature sensor 18. Although the preferred embodiment of control 10 incorporates four latches, it will be understood that one or more or any desired number of latches can be used, depending upon the desired number of temperature setpoints, and that the precise number of latches is not critical to practice of the invention. Four latches have been found satisfactory although a different number of latches may also be suitable. Each of the latches 40, 42, 44 and 46 has a predetermined setpoint temperature. For example, latch 40 has a setpoint temperature T1 of about 40° F., which is the upper threshold temperature. Latch 42 has a setpoint temperature T2 of about 37° F. Latch 44 has a setpoint temperature T3 of about 35° F. Latch 46 has a setpoint temperature T4 of about 33.5° F., which is the lower threshold temperature. Water freezes at about 32° F. which is the critical temperature.

It will thus be appreciated that latches 40, 42, 44 and 46 are set successively as and if the temperature in water line 22 approaches freezing. With the setting of successive latches, the timing control 36 energizes valve 20 for predetermined open/closed time intervals, after which the latches are reset to re-initialize the control 10. Colorcoded indicator lights are preferably coupled to the latches to provide a visual indication of the temperature in the water line 22. For example, indicator lights 48 and 50 are coupled to latch 40. The indicator light 48, which is preferably green, is normally on when control 10 is energized but latch 40 has not been set. When the temperature in water line 22 reaches T1, latch 40 sets, turning off indicator light 48 and turning on indicator light 50, which is preferably yellow. Responsive to setting of the first latch 40, the timing control 36 opens valve 20 for a first predetermined time interval, after which the valve closes and resets all of the latches 40, 42, 44 and 46 after predetermined timed delays. Similarly, indicator lights 52 and 54, which are also preferably yellow, are coupled to the second and third latches 42 and 44 and come on when the temperature in water line 22 drops to their respective setpoint temperatures T2 and T3, thereby opening valve 20 via timing control 36 for similar timed intervals.

The timing control 36 is programmed to decrease the open/closed cycle time of valve 20 according to the latch(es) set. The open time can be substantially uniform or increasing, while the closed time can be decreasing or substantially uniform, or vice versa, with decreasing water temperature. Decreasing predetermined time delays after closings of the valve 20, together with constant increasing opening times, are preferable to avoid over-cycling.

In accordance with the preferred embodiment, the time delay between openings of valve 20, however, is controlled by the lowest temperature monitored during the previous closed/open cycle. For example, if the temperature in the water line 22 is above temperature T1, no setting of any of the latches 40, 42, 44 and 46 occurs and the timing control 36 merely operates to open valve 20 for about two minutes and then closes it for about sixty-two minutes. It is assumed that control 10 would only be used during cold weather when there is the possibility of water line freeze damage and at least some minimal valve cycling is desirable, but it would not normally be plugged in during warm weather. If the setpoint temperature T1 is met, the first latch 40 sets and the valve 20 is opened for about two minutes and then closed for about fourteen minutes, after which the latches are reset. If the setpoint temperature T2 is met, the second latch 42 sets and valve 20 is opened for about two minutes and closed for six minutes, after which the latches are reset. If the setpoint temperature T3 is met, the third latch 44 sets and the valve 20 is opened for about two minutes and closed for about two minutes, after which the latches are reset. The closing time or delay between openings of valve 20 decreases with decreasing temperature, with setting of successive latches, such that the valve is held open longer with decreasing water temperature in line 22.

It will be noted that the fourth latch 46 is coupled both to the timing control 36 and to the valve 20, while the other latches 40, 42 and 44 are only coupled to the timing control. If the lowest setpoint temperature T4 is met, the fourth latch 46 sets and immediately opens valve 20 for a predetermined time interval, regardless of the lowest temperature sensed by control 10 during previous closed/open cycles of the valve. An indicator light 56, which is preferably red to signal a hazardous condition, is coupled to the fourth latch 46. When the fourth latch 46 sets, indicator light 56 comes on along with lights 50, 52 and 54 which are already on due to setting of their respective latches 40, 42 and 44.

A table of the operating cycle data of the control 10 is set forth below.

| Latch | Setpoint Temp. | Water Temp. Range* | Indicator Lights | Valve Operation |
|---|---|---|---|---|
| 46 | T4 | 33.5° F. and below | 1 Red<br>3 Yellow | On For At Least 1 Hour After Temp. Dropped Below 33.5° F. |
| 44 | T3 | 33.5 to 35° F. | 3 Yellow | On For 2 Min.<br>Off For 2 Min. |
| 42 | T2 | 35 to 37° F. | 2 Yellow | On For 2 Min.<br>Off For 6 Min. |
| 40 | T1 | 37 to 40° F. | 1 Yellow | On For 2 Min.<br>Off For 14 Min. |
| | | Above 40° F. | 1 Green | On For 2 Min.<br>Off For 62 Min. |

Where T1 = 40° F., T2 = 37° F., T3 = 35° F., and T4 = 33.5° F.
*Setpoints may be adjusted as necessary for optimum performance.

If desired, a buzzer or tone generator (not shown) can be coupled to latch 46 to provide an audible warning in addition to the indicator lights. A separate on/off power switch (not shown) could also be incorporated into control 10, if desired.

Although control 10 has been illustrated and described with an on/off solenoid valve 20, a variable or modulating solenoid valve could be used to control the rate of water flow, with appropriate correlation of the cycle times as necessary. Modulating solenoid valves are generally more expensive than on/off solenoid valves, but could provide even better operating efficiency.

From the foregoing, it will thus be apparent that the present invention comprises an automatic water line freeze control having numerous advantages over the prior art. The control herein monitors water temperature on a continuous basis and selectively opens a valve in the water line at programmed intervals responsive to the temperature to allow flow and thus help avoid potential freeze damage without the manual attention and inefficiencies associated with the prior art. Other advantages will be evident to those skilled in the art.

Although particular embodiments of the invention have been illustrated in the accompanying drawings and described in the foregoing detailed description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. Apparatus for automatically controlling flow in a water line to avoid freeze damage, comprising:

a temperature sensor connected to the water line;

a normally-closed valve connected to the water line; and control circuit means responsive to said temperature sensor for continuously monitoring the temperature of water in the line and selectively opening and closing said valve to allow increased periodic flow with decreasing temperature in the water line for a plurality of predetermined time intervals in response to a plurality of predetermined sensed temperatures in said water line.

2. The apparatus of claim 1, wherein said temperature sensor comprises a thermistor.

3. The apparatus of claim 1, wherein said valve comprises a solenoid valve.

4. The apparatus of claim 1, wherein said control circuit means comprises:

timing control means connected to said valve;

a clock connected to said timing control means; and a plurality of latches connected between said temperature sensor and said timing control means, said latches having different setpoint temperatures ranging between predetermined upper and lower temperatures above freezing;

said timing control means being programmed to open said valve for progressively longer intervals with decreasing temperature.

5. The apparatus of claim 1, further including:

indicator means connected to said control circuit means for indicating the proximity of the temperature of water in said water line to freezing.

6. Apparatus for automatically controlling flow in a water line to avoid freeze damage, comprising:

a temperature sensor adapted for connection to the water line; the water line;

a normally-closed valve adapted for connection to a housing;

control circuit means within said housing and responsive to said temperature sensor for continuously monitoring the temperature of water in the line and selectively opening and closing said valve to allow increased periodic flow in the water line with decreasing water temperature; and indicator means associated with said housing and connected to said control circuit means for indicating the temperature proximity of water in the line to freezing.

7. The apparatus of claim 6, wherein said temperature sensor comprises a thermistor.

8. The apparatus of claim 6, wherein said valve comprises a solenoid valve.

9. The apparatus of claim 6, wherein said control circuit means comprises:

a plurality of latches connected to said temperature sensor and said timing control means, said latches having different setpoint temperatures ranging between predetermined upper and lower temperatures above freezing;

timing control means connected between said latches and said valve; and a clock connected to said timing control means;

said timing control means being programmed to open said valve at periodically decreasing time intervals with decreasing temperature.

10. Apparatus for automatically controlling flow in a water line to avoid freeze damage, comprising:

a temperature sensor adapted for connection to the water line;

a normally-closed valve adapted for connection to the water line;

timing control means connected to said valve;

a clock connected to said timing control means:

a pluality of latches connected between said temperature sensor and said timing control means, said latches having different predetermined setpoint temperatures ranging between predetermined upper and lower temperatures above freezing;

said timing control means being programmed to open and close said valve periodically for predetermined time intervals between predetermined decreasing time delays in accordance with successive setting of said latches and decreasing temperature of water in the water line; and indicator means connected to said control circuit means for indicating proximity to freezing of the temperature of water in said water line.

* * * * *